US006948748B2

(12) United States Patent
Romero

(10) Patent No.: US 6,948,748 B2
(45) Date of Patent: Sep. 27, 2005

(54) DOOR HANDLE SPRING ASSEMBLY

(75) Inventor: Oscar Romero, Lake Forest, CA (US)

(73) Assignee: Newfrey LLC, Newark, DE (US)

( * ) Notice: Subject to any disclaimer, the term of this patent is extended or adjusted under 35 U.S.C. 154(b) by 30 days.

(21) Appl. No.: 10/733,010

(22) Filed: Dec. 11, 2003

(65) Prior Publication Data

US 2005/0126236 A1 Jun. 16, 2005

(51) Int. Cl.[7] ..... E05B 3/04

(52) U.S. Cl. ..... 292/353; 292/252; 292/336.3; 70/224; 403/327; 267/154

(58) Field of Search ..... 70/187, 209, 215–217, 70/224, DIG. 54, DIG. 55; 292/1.5, 137, 292/169, 169.18, 336.3, 337, 348–349, 352–355, 292/DIG. 55; 403/325–329; 267/154

(56) References Cited

U.S. PATENT DOCUMENTS

| | | | | |
|---|---|---|---|---|
| 473,988 | A | 5/1892 | Whipple | |
| 1,128,339 | A * | 2/1915 | McDonald | 292/353 |
| 1,245,939 | A | 11/1917 | Mallatt | |
| 1,653,514 | A | 12/1927 | Schlage | |
| 2,015,918 | A | 10/1935 | Brabant | |
| 2,252,855 | A * | 8/1941 | Lasch | 292/353 |
| 2,517,240 | A | 8/1950 | Roberts | |
| 2,676,050 | A | 4/1954 | Nichols | |
| 2,801,123 | A | 7/1957 | Kubik et al. | |
| 2,842,389 | A | 7/1958 | Muttart | |
| 2,976,073 | A * | 3/1961 | Russell et al. | 292/352 |
| 3,019,045 | A | 1/1962 | Jaggi | |
| 3,091,490 | A | 5/1963 | Williams | |
| 3,128,115 | A * | 4/1964 | Patriquin et al. | 292/336.3 |
| 3,130,990 | A | 4/1964 | Leitmann | |
| 3,177,024 | A * | 4/1965 | Krook et al. | 292/353 |
| 3,427,061 | A * | 2/1969 | McMeen et al. | 292/353 |
| 3,468,568 | A * | 9/1969 | Ulich | 292/353 |
| 3,754,423 | A * | 8/1973 | Seidewand | 70/455 |
| 4,342,478 | A | 8/1982 | Foshee | |
| 4,428,570 | A | 1/1984 | Foshee et al. | |
| 4,437,695 | A | 3/1984 | Foshee | |
| 4,639,026 | A | 1/1987 | Smallegan | |
| 4,653,784 | A | 3/1987 | Lee | |
| 4,655,059 | A | 4/1987 | Best et al. | |
| 4,995,249 | A | 2/1991 | Preissler et al. | |
| 5,016,927 | A | 5/1991 | Toledo | |
| 5,575,516 | A | 11/1996 | Baumgarten | |
| 5,598,726 | A | 2/1997 | Cordle | |
| 5,617,750 | A * | 4/1997 | Preddey | 70/419 |
| 5,688,005 | A | 11/1997 | Ellis | |
| 5,782,119 | A * | 7/1998 | Ellis et al. | 70/371 |
| 5,947,537 | A | 9/1999 | Aigner et al. | |
| 6,357,270 | B1 | 3/2002 | Vazquez | |
| 6,412,319 | B1 | 7/2002 | Adelmeyer et al. | |
| 6,425,273 | B1 | 7/2002 | Kim et al. | |
| 2001/0026071 | A1 | 10/2001 | Kemp et al. | |

* cited by examiner

*Primary Examiner*—Daniel P. Stodola
*Assistant Examiner*—Christopher Boswell
(74) *Attorney, Agent, or Firm*—Harness, Dickey & Pierce, P.L.C.

(57) ABSTRACT

A door handle spring assembly for biasing a catch releasably coupling a door handle to a sleeve. The spring assembly includes a first arm engaged with the catch, a second arm extending outwardly from the sleeve, and a loop portion formed between the first and second arms. The first arm and the loop portion are retained within the sleeve. The spring assembly further functions to exert a radial biasing force between the handle and the sleeve to minimize play therebetween.

10 Claims, 3 Drawing Sheets

DOOR HANDLE SPRING ASSEMBLY

FIELD OF THE INVENTION

The present invention relates to a door handle assembly and more particularly to a lockset mechanism for a door handle assembly.

BACKGROUND OF THE INVENTION

Door handle assemblies typically include an internal locking mechanism which operates a bolt extending from a door into a door jamb. The locking mechanism and bolt are operably controlled by a pair of operator portions, usually levers or knobs. A sleeve supports the operator portions in a pair of mounting plates which are fixed to the door.

The operator portions have a bore formed at one end sized to receive the sleeve. The sleeve typically includes a catch to releasably secure the operator portion. The catch is mounted within the sleeve and moves to engage the operator portion when the operator portion is slid onto the sleeve. A spring biases the catch to engage the operator portion to lock it to the sleeve, preventing removal of the operator portion without first disengaging the catch.

While the above method of assembly easily allows the operator portion to be attached to the door handle assembly, often there can be play between the operator portion and the sleeve. This play is, in part, due to the necessary draft between the bore of the operator portion and the sleeve that allows the operator portion to receive the sleeve. This play is undesirable since it may be associated with poor quality and workmanship.

Therefore, it is an object of the present invention to provide the art with an improved sleeve and spring design that operates a catch while also eliminating the play between the sleeve and an attached operator portion.

SUMMARY OF THE INVENTION

A door handle assembly is provided which includes a sleeve having a transverse slot extending into the sleeve and a catch mounted in the transverse slot. The catch is moveable between an extended position and a retracted position. A spring is mounted within the sleeve and includes a first arm engaged with the catch, a second arm extending outwardly from the sleeve, and a loop portion formed between the first and second arms. The first arm and the loop portion are retained within the sleeve. The door handle assembly further includes a handle assembly having an operator portion and a shank portion that extends out from the operator portion. The shank portion also has a transverse slot formed therein. The sleeve is received within the shank portion and a portion of the catch extends into the second slot when the catch is in its extended position. The first arm of the spring biases the catch into the extended position while the second arm biases the handle assembly tightly against the sleeve.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

Figure 1:
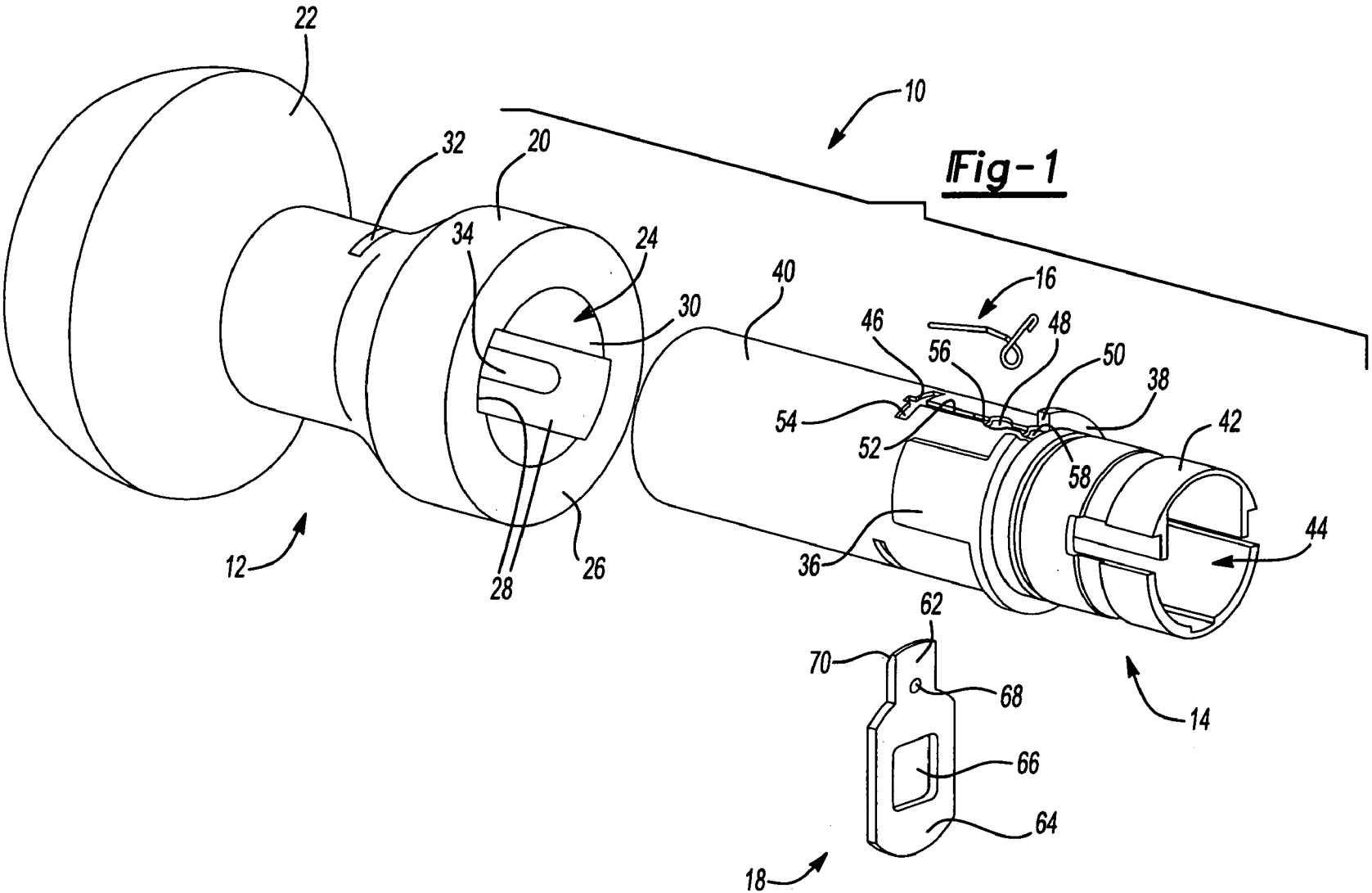
FIG. 1 is an exploded view of a door handle assembly having a lockset mechanism according to the principles of the present invention.

The following description of the preferred embodiment is merely exemplary in nature and is in no way intended to limit the invention, its application, or uses.

Referring generally to the drawings, a door handle assembly constructed in accordance with the teachings of the present invention is generally indicated by reference numeral 10. In the particular embodiment provided, the door handle assembly 10 is shown to include a handle assembly 12, a sleeve 14, a torsional spring 16, and a catch 18.

Figure 3:
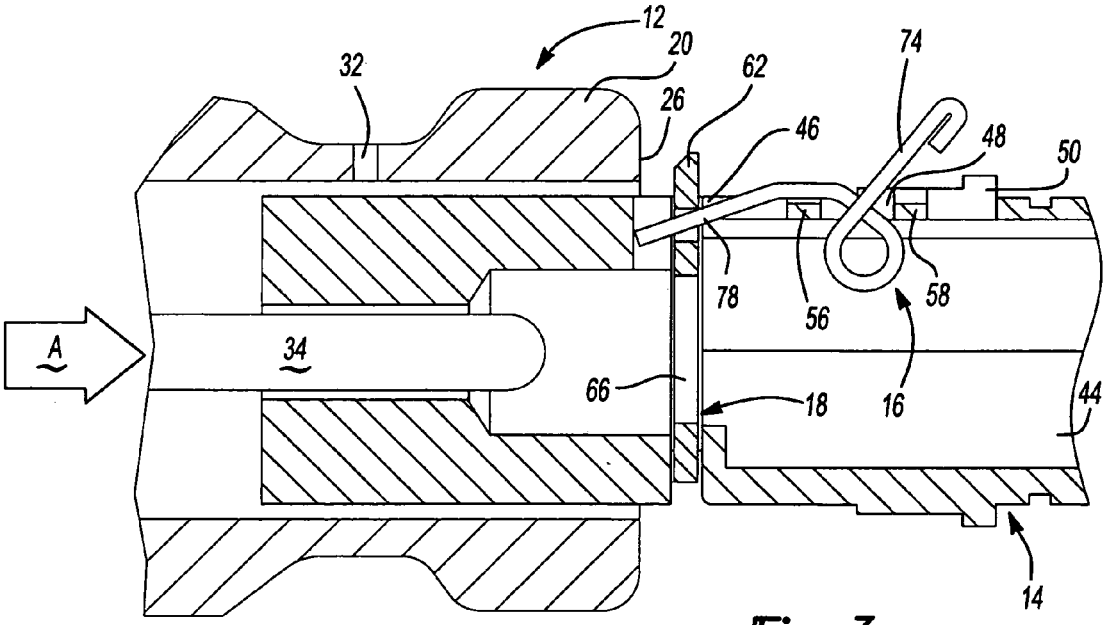
FIG. 3 is a side sectional view of the lockset mechanism in which the handle and sleeve are in an uncoupled state.
Figure 4:
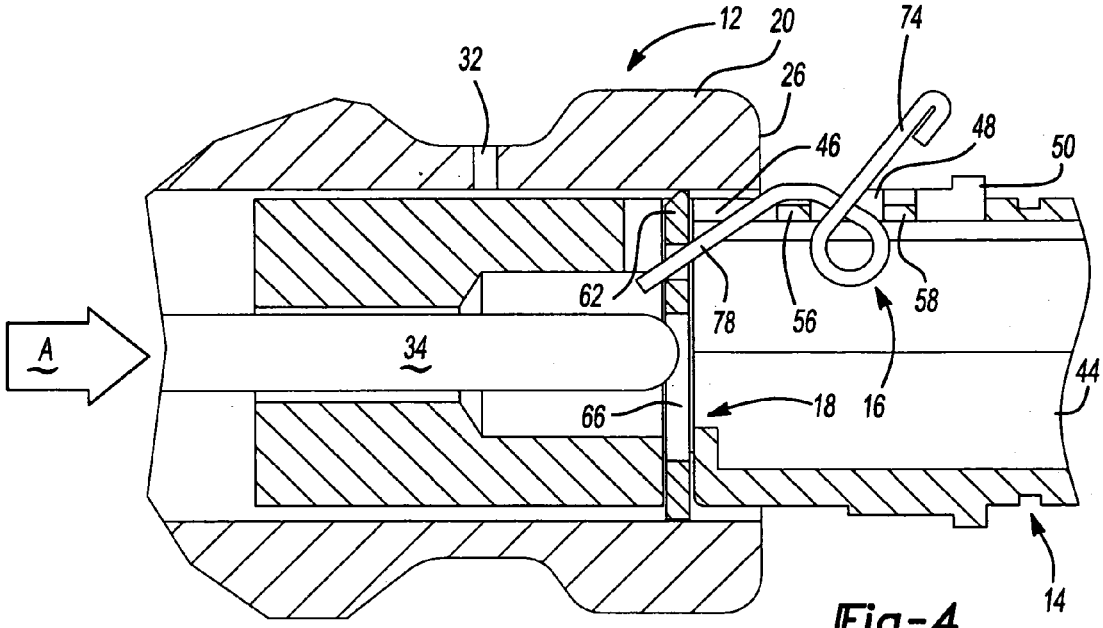
FIG. 4 is a side sectional view of the lockset mechanism shown in FIG. 3 in a transitional state.
Figure 5:
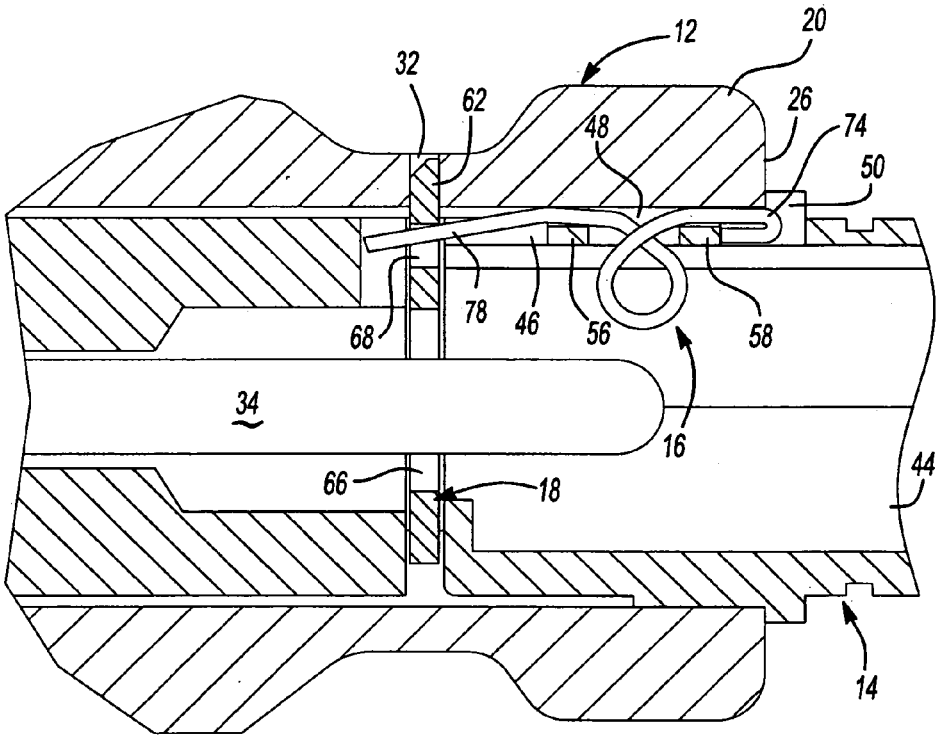
FIG. 5 is a side sectional view of the lockset mechanism shown in FIG. 3 in a coupled state.

The handle assembly 12 includes a shank portion 20 extending out from an operator portion 22. The operator portion 22 is shown as a conventional doorknob, however, various other designs of the operator portion 22 may be employed, for example a lever handle. The shank portion 20 includes a bore 24 formed therein. The bore 24 extends from an end face 26 of the shank portion 20 to the operator portion 22. A pair of grooves 28 are formed on an inner surface 30 of the bore 24. The bore 24 and the grooves 28 are sized to receive the sleeve 14, as will be described in greater detail below. A catch slot 32 formed in the shank portion 20 extends transversely from an outer surface of the shank portion 20 to the bore 24. The catch slot 32 is sized to receive a portion of the catch 18, as will also be described in greater detail below. A turnpiece shaft 34, as seen in FIGS. 3–5, extends from the operator portion 22 through the shank portion 20 within the bore 24. The turnpiece shaft 34 forms part of an operator locking mechanism for locking the door handle assembly 10 to prevent rotation of the handle assembly 12 with respect to a door (not shown). In the particular example provided, handle assembly 12 is shown to have a single, unitary construction. However, the shank portion 20 and the operator portion 22 may be constructed as separate pieces and assembled together using conventional methods.

The sleeve 14 is generally cylindrical in shape and includes a pair of tabs 36 and a radial lip 38 formed on an outer surface thereof. The pair of tabs 36 extend from the lip 38 and fit within the pair of grooves 28 of the shank portion 20. The portions of the sleeve 14 extending from opposite sides of the radial lip 38 form a first mounting portion 40 and a second mounting portion 42. The first mounting portion 40 is received within operator 12 and the second mounting portion 42 is rotatably supported in a mounting plate (not shown) securable to the door. The sleeve 14 defines a cavity 44 that runs longitudinally through the sleeve 14.

The sleeve 14 further includes a slot 46 and a pair of holes 48, 50. The slot 46 and hole 48 are formed in the first mounting portion 40 and the hole 50 is formed in the radial lip 38. The slot 46 and holes 48 and 50 all extend from the outer surface of the sleeve 14 into the cavity 44 and are arranged in a longitudinal row with respect to the sleeve 14. The slot 46 has a longitudinal portion 52 and a transverse portion 54 arranged in a cross-like shape. The radial portion 54 is sized to receive a portion of the catch 18 and the longitudinal portion 52 is sized to receive a portion of the torsional spring 16, as will be described in greater detail below. The holes 48, 50 are sized to receive portions of the torsional spring 16, which will likewise be described in greater detail below. It is to be understood that apertures of any particular shape may be employed for the slot 46 and holes 48, 50 so long as they are sized to perform their respective functions.

A first support member 56 separates the longitudinal portion 52 of the first slot 46 from the hole 48. A second support member 58 separates the hole 48 from the hole 50. The support members 56, 58 are relieved from the surface of the sleeve 14 and have a reduced thickness with respect to the thickness of the sleeve 14, as best seen in FIGS. 3–5.

In the particular example provided, the sleeve 14 is made from a single piece die-cast metal. However, the sleeve 14 may also be formed from a combination of separate pieces each assembled and attached using conventional methods.

The catch 18 is generally planar and includes an extension 62 extending out from a body 64. An aperture 66 is formed within the body 64. The extension 62 has a hole 68 formed therein and a sloped front face 70. The hole 68 is sized to receive a portion of the torsional spring 16. As indicated above, the extension 62 of the catch 18 is sized to fit within the transverse portion 54 of slot 46 in the sleeve 14 and the catch slot 32 of the handle assembly 12.

Figure 2:
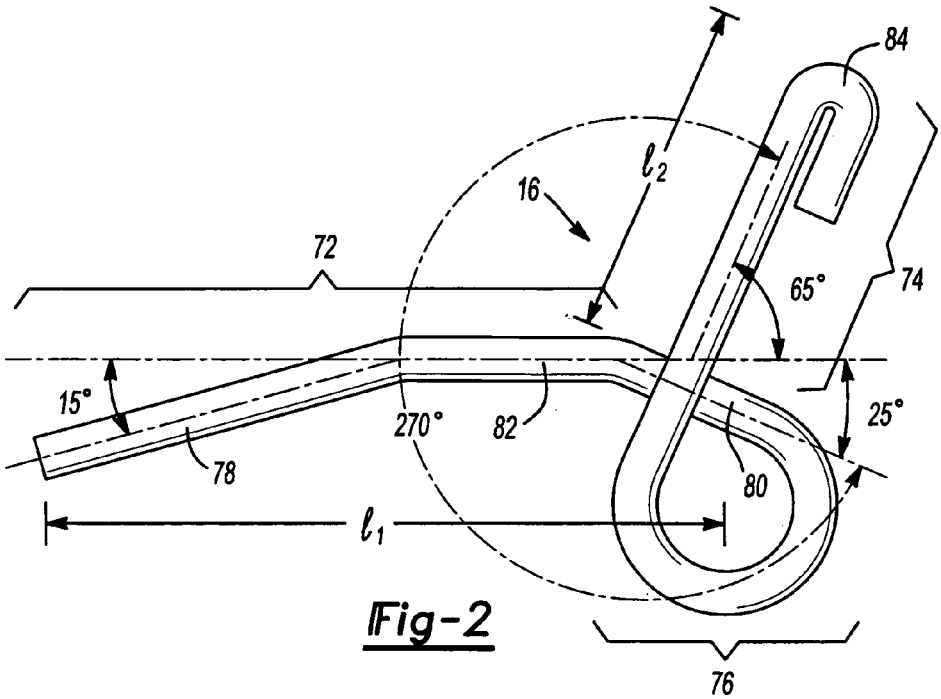
FIG. 2 is an enlarged side view of a torsional spring of the lockset mechanism according to the principles of the present invention.

Referring to FIG. 2, the torsional spring 16 will now be described according to a preferred embodiment of the present invention. The torsional spring 16 includes a first arm 72, a second arm 74, and a loop portion 76 formed therebetween. The torsional spring 16 is made from a 21 gauge (0.031"). The loop portion 76 formed between the base portion 80 of the first arm 72 and the second arm 74 creates a 270 degree arc.

The first arm 72 includes an end portion 78, a base portion 80, and a support portion 82 formed therebetween. In the preferred embodiment, the end portion 78 is angled down approximately 15 degrees with respect to the support portion 82. The base portion 80 feeds into the loop portion 76 and is angled down approximately 25 degrees with respect to the support portion 82. The first arm 72 has a length designated as $l_1$ in FIG. 2.

The second arm 74 is angled up approximately 65 degrees with respect to the support portion 82. The second arm 74 includes a bent portion 84 at its end. In the particular example provided, the bent portion 84 is angled approximately 180 degrees with respect to the second arm 74. The second arm 74 has a length designated as $l_2$ in FIG. 2. The length $l_2$ of the second arm 74 is approximately half the length $l_1$ of the first arm 72.

Referring now to FIG. 3, the installation of the handle assembly 12 onto the sleeve 14 will be described. The catch 18 is mounted within the cavity 44 of the sleeve 14 such that the extension 62 extends through the slot 46. The spring 16 is mounted within the sleeve 14 such that the loop portion 76 extends into the cavity 44 through hole 48. The support portion 82 rests on the first support member 56. The end portion 78 extends down through the longitudinal portion 52 of the slot 46 and engages the hole 68 of the catch 18. The second arm 74 extends out from the hole 48 away from the sleeve 14.

Referring to FIG. 4, the handle assembly 12 slides onto the sleeve 14 as indicated by arrow A. The end face 26 of the shank 20 engages the sloped front face 70 of the catch 18, urging the catch to a retracted position within the sleeve 14. This urges the first arm 72 of the spring 16 downwards. The loop portion 76 is forced upwards but is retained in place by support member 58. The turnpiece shaft 34 extends through the central aperture 66 of the catch 18. As the handle assembly 12 moves in the direction of arrow A, the tabs 36 fit within the grooves 28 to radially align the handle assembly 12 with respect to the sleeve 14.

Referring to FIG. 5, as the handle assembly 12 is moved further in the direction of arrow A, the end face 26 engages the second arm 74 of the spring 16. The second arm 74 is urged towards the sleeve 14 until the bent portion 84 at its end fits within the third slot 50 and the second arm 74 contacts the second support member 58. The second arm 74 provides a biasing force radially outward against the handle assembly 12 to urge the handle assembly 12 tight against the sleeve 14. This takes up any play between the handle assembly 12 and the sleeve 14, resulting in a more solid feeling connection.

When the catch slot 32 of the handle assembly 12 aligns with the first slot 46, the spring 16 urges the catch 18 back to its extended position such that the extension 62 fits through the first slot 46 and the catch slot 32. In this way, the catch 18 couples the handle assembly 12 relative to the sleeve 14. To remove the handle assembly 12 from the sleeve 14, the catch 18 is depressed down towards the sleeve 14 to its retracted position, and the handle assembly 12 may be removed in a direction opposite of arrow A.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A lockset mechanism comprising:

a sleeve having a transverse slot extending into said sleeve;

a catch mounted in said transverse slot and moveable between an extended position and a retracted position; and a spring having a first arm engaged with said catch, a second arm extending radially outward from said sleeve and a loop portion extending in an arc of at least 180 degrees to form a torsional spring between said first and second arms, said first arm and said loop portion being retained within said sleeve;

wherein the torsional spring biases the second arm away from the sleeve.

2. The lockset mechanism of claim 1, wherein said sleeve includes an aperture extending into said sleeve, said second arm extending out from said aperture.

3. The lockset mechanism of claim 2, wherein said first arm of said spring extends out from said aperture and then into said aperture.

4. The lockset mechanism of claim 3, wherein said sleeve includes a support member disposed between said transverse slot and said aperture, said support member supporting a portion of said first arm of said spring.

5. The lockset mechanism of claim 1, wherein said second arm includes a bent portion at its end.

6. The lockset mechanism of claim 1, wherein said first arm is approximately twice the length of said second arm.

7. A door handle assembly comprising:

a sleeve having a first slot extending into said sleeve;

a catch mounted in said first slot and moveable between an extended position and a retracted position;

a spring having a first arm engaged with said catch, a second arm extending radially outward from said sleeve and a loop portion extending in an arc of at least 180 degrees to form a torsional spring between said first and second arms, said first arm and said loop portion being retained within said sleeve;

a handle assembly including an operator portion and a shank extending from said operator portion, said shank having a second slot formed therein;

wherein said sleeve is received within said shank and a portion of said catch extends into said second slot to releasably couple said handle assembly to said sleeve and wherein the torsional spring biases the second arm into engagement with the handle assembly.

8. The door handle assembly of claim 7, wherein said handle assembly urges said second arm of said spring towards said sleeve when said sleeve is received within said shank.

9. The door handle assembly of claim 8, wherein said sleeve includes an aperture receiving a portion of said second arm when said second arm is urged towards said sleeve by said handle assembly.

10. The door handle assembly of claim 9, wherein said second arm imparts a biasing force between said handle assembly and said sleeve.

* * * * *